US009747832B2

(12) United States Patent
Kim et al.

(10) Patent No.: US 9,747,832 B2
(45) Date of Patent: Aug. 29, 2017

(54) ORGANIC LIGHT EMITTING DISPLAY DEVICE AND DRIVING METHOD THEREOF

(71) Applicant: Samsung Display Co., Ltd., Yongin, Gyeonggi-do (KR)

(72) Inventors: Jung-Taek Kim, Yongin (KR); Bong-Hyun You, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 123 days.

(21) Appl. No.: 14/596,099

(22) Filed: Jan. 13, 2015

(65) Prior Publication Data

US 2015/0243208 A1 Aug. 27, 2015

(30) Foreign Application Priority Data

Feb. 24, 2014 (KR) ..... 10-2014-0021187

(51) Int. Cl.

| | |
|---|---|
| ***G09G 3/32*** | (2016.01) |
| ***G09G 3/3225*** | (2016.01) |
| ***G09G 3/20*** | (2006.01) |

(52) U.S. Cl.

CPC ..... *G09G 3/3225* (2013.01); *G09G 3/2022* (2013.01); *G09G 2310/0202* (2013.01); *G09G 2310/0221* (2013.01); *G09G 2310/0283* (2013.01); *G09G 2310/08* (2013.01)

(58) Field of Classification Search

CPC ..... G09G 3/3233; G09G 2300/0819; G09G 2300/0861; G09G 2300/0852; G09G 2320/045; G09G 2320/043; G09G 3/3291; G09G 2300/0842; G09G 2310/0262; G09G 2300/0866; G09G 2310/0251; G09G 3/3208; G09G 3/3225; G09G 2320/0223; G09G 2320/0233

See application file for complete search history.

(56) References Cited

U.S. PATENT DOCUMENTS

| | | | | |
|---|---|---|---|---|
| 2005/0046619 | A1 | 3/2005 | Senda et al. | |
| 2006/0044252 | A1* | 3/2006 | Ryu | G09G 5/395 345/98 |
| 2006/0279489 | A1* | 12/2006 | Ouchi | G09G 3/20 345/76 |
| 2008/0158140 | A1* | 7/2008 | Takatori | G09G 3/3651 345/102 |
| 2009/0002264 | A1* | 1/2009 | Pai | G09G 3/3666 345/3.2 |
| 2009/0073079 | A1* | 3/2009 | Miller | G09G 3/3216 345/1.3 |

(Continued)

FOREIGN PATENT DOCUMENTS

| | | | |
|---|---|---|---|
| KR | 10-2009-0120359 | A | 11/2009 |
| KR | 10-2012-0059351 | A | 6/2012 |

*Primary Examiner* — Md Saiful A Siddiqui

(74) *Attorney, Agent, or Firm* — Lewis Roca Rothgerber Christie LLP

(57) ABSTRACT

An organic light emitting display includes: a data driver configured to supply a data signal to data lines, corresponding to a data enable signal during a driving period in which an image is displayed; and a timing controller configured to supply data and the data enable signal to the data driver, wherein a first data enable signal having a first period and a second data enable signal having a second period differing from the first period are included in the data enable signal supplied during one frame period.

16 Claims, 7 Drawing Sheets

(56) References Cited

U.S. PATENT DOCUMENTS

| | | | | |
|---|---|---|---|---|
| 2009/0284455 | A1 | 11/2009 | Jung | |
| 2010/0053146 | A1* | 3/2010 | Han | G09G 3/2096 345/214 |
| 2012/0133635 | A1 | 5/2012 | Ji et al. | |
| 2012/0169678 | A1* | 7/2012 | Shin | G09G 3/20 345/204 |
| 2015/0170578 | A1* | 6/2015 | Choi | G09G 3/3266 345/212 |

* cited by examiner

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2014-0021187, filed on Feb. 24, 2014, in the Korean Intellectual Property Office, the entire content of which is incorporated herein by reference in its entirety.

BACKGROUND

1. Field

Aspects of embodiments of the present invention relate to an organic light emitting display device and a driving method thereof.

2. Description of the Related Art

With the development of information technologies, the importance of a display device, which is a connection medium between a user and information, increases. Accordingly, flat panel displays (FPDs) such as a liquid crystal display (LCD), an organic light emitting display device (OLED) and a plasma display panel (PDP) are increasingly used.

SUMMARY

Aspects of embodiments of the present invention are directed toward an organic light emitting display and a driving method thereof, which can increase (e.g., improve) image quality.

According to an embodiment of the present invention, there is provided an organic light emitting display including: a data driver configured to supply a data signal to data lines, corresponding to a data enable signal during a driving period in which an image is displayed; and a timing controller configured to supply data and the data enable signal to the data driver, wherein a first data enable signal having a first period and a second data enable signal having a second period differing from the first period are included in the data enable signal supplied during one frame period.

The timing controller may be configured to: generate and supply an initial data enable signal so that j clock signals are included in one period during a first frame period after power is input, wherein j is a natural number; calculate a number of clock signals supplied during a blank period in which the initial data enable signal is not supplied in the first frame period; and control a number of clock signals to be included in the period of the initial data enable signal during a second frame period, using the following:

$$CLK(N) = CLK(O) + \text{int}\left(\frac{CLK(R)}{DE(T)}\right),$$

and wherein CLK(N) denotes the number of clock signals to be included in one period of the initial data enable signal during the second frame period, CLK(O) denotes the number (i.e., j) of clock signals included in the one period of the initial data enable signal during the first frame period, CLK(R) denotes the number of clock signals supplied during the blank period, DE(T) denotes the total number of data enable signals to be supplied in one frame period, and int denotes taking only an integer.

The timing controller may be configured to: supply the initial data enable signal by controlling the period of the initial data enable signal so that p clock signals are included in one period, corresponding to the equation, during the second frame period, wherein p is a natural number equal to or greater than j; calculate a number of clock signals supplied during the blank period of the second frame period; and generate the first data enable signal including p clock signals in the one period and the second data enable signal including l clock signals in the one period, to reduce the blank period, and supply the generated first and second data enable signals to a next frame period, wherein l is a natural number greater than p.

When the frame period is shortened in the driving period, the timing controller may be configured to calculate a number of clock signals additionally supplied after the frame period, and to control widths of the first and second periods by the following:

$$CLK(N) = CLK(O) - \text{int}\left(\frac{CLK(R')}{DE(T)}\right) - 1,$$

and wherein CLK(O) denotes a number of clock signals included in the one period of each of the first and second data enable signals, CLK(N) denotes the number of clock signals to be included in the one period of each of the first and second data enable signals, CLK(R') denotes a number of the additionally supplied clock signals, DE(T) denotes a total number of data enable signals to be supplied in one frame period, and int denotes taking only an integer.

The timing controller may be configured to: control widths of the first and second periods corresponding to the equation, and calculate the number of clock signals supplied during a blank period; and control the number of the first and second data enable signals to reduce the blank period during a next frame period.

The data lines may include first data lines at a first display area at an upper side of a panel, and second data lines at a second display area at a lower side of the panel, and wherein the data driver includes a first data driver configured to drive the first data lines, and a second data driver configured to drive the second data lines.

The organic light emitting display may further include: first scan lines at the first display area; second scan lines at the second display area; a first scan driver configured to non-sequentially supply a scan signal to the first scan lines; and a second scan driver configured to non-sequentially supply a scan signal to the second scan lines.

The first display area may be configured to display an image corresponding to data of an N-th frame period and an (N−1)-th frame period, wherein N is a natural number, and wherein the second display area is configured to display an image corresponding to data of the (N−1)-th frame period and an (N−2)-th frame period.

The organic light emitting display may further include a storage unit configured to have four memories to supply data of three frame periods to the timing controller.

According to another embodiment of the present invention, there is provided a method of driving an organic light emitting display, the method including: supplying an initial data enable signal during an i-th frame period, wherein i is a natural number; calculating a number of clock signals supplied during a first blank period in which the initial data enable signal is not supplied in the i-th frame period; supplying the initial data enable signal during an (i+1)-th frame period by controlling the period of the initial data enable signal to reduce the first blank period; calculating a number of clock signals supplied during a second blank period in the (i+1)-th frame period; and supplying concurrently a first data enable signal having a first period and a second data enable signal having a second period differing from the first period to decrease the second blank period during a (i+2)-th frame period.

The period of the initial data enable signal may be controlled by the following:

$$CLK(N) = CLK(O) + \text{int}\left(\frac{CLK(R)}{DE(T)}\right),$$

and wherein CLK(N) denotes a number of clock signals to be included in one period of the initial data enable signal during the (i+1)-th frame period, CLK(O) denotes a number of clock signals included in the one period of the initial data enable signal during the i-th frame period, CLK(R) denotes a number of clock signals supplied during the first blank period, DE(T) denotes a total number of data enable signals to be supplied in one frame period, and int denotes taking only an integer.

The first period may be a period equal to that of the initial data enable signal, and the second period may have a width wider than that of the first period.

The method may further include, when a frame period is shortened during driving, calculating a number of clock signals additionally supplied after the shortened frame period, and controlling widths of the first and second periods, by the following:

$$CLK(N) = CLK(O) - \text{int}\left(\frac{CLK(R')}{DE(T)}\right) - 1,$$

and wherein CLK(O) denotes a number of clock signals included in the one period of each of the first and second data enable signals, CLK(N) denotes a number of clock signals to be included in the one period of each of the first and second data enable signals, CLK(R') denotes a number of the additionally supplied clock signals, DE(T) denotes a total number of data enable signals to be supplied in one frame period, and int denotes taking only an integer.

The i-th frame period may be a first frame period after power is input.

BRIEF DESCRIPTION OF THE DRAWINGS

Example embodiments of the present invention will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments of the present invention to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
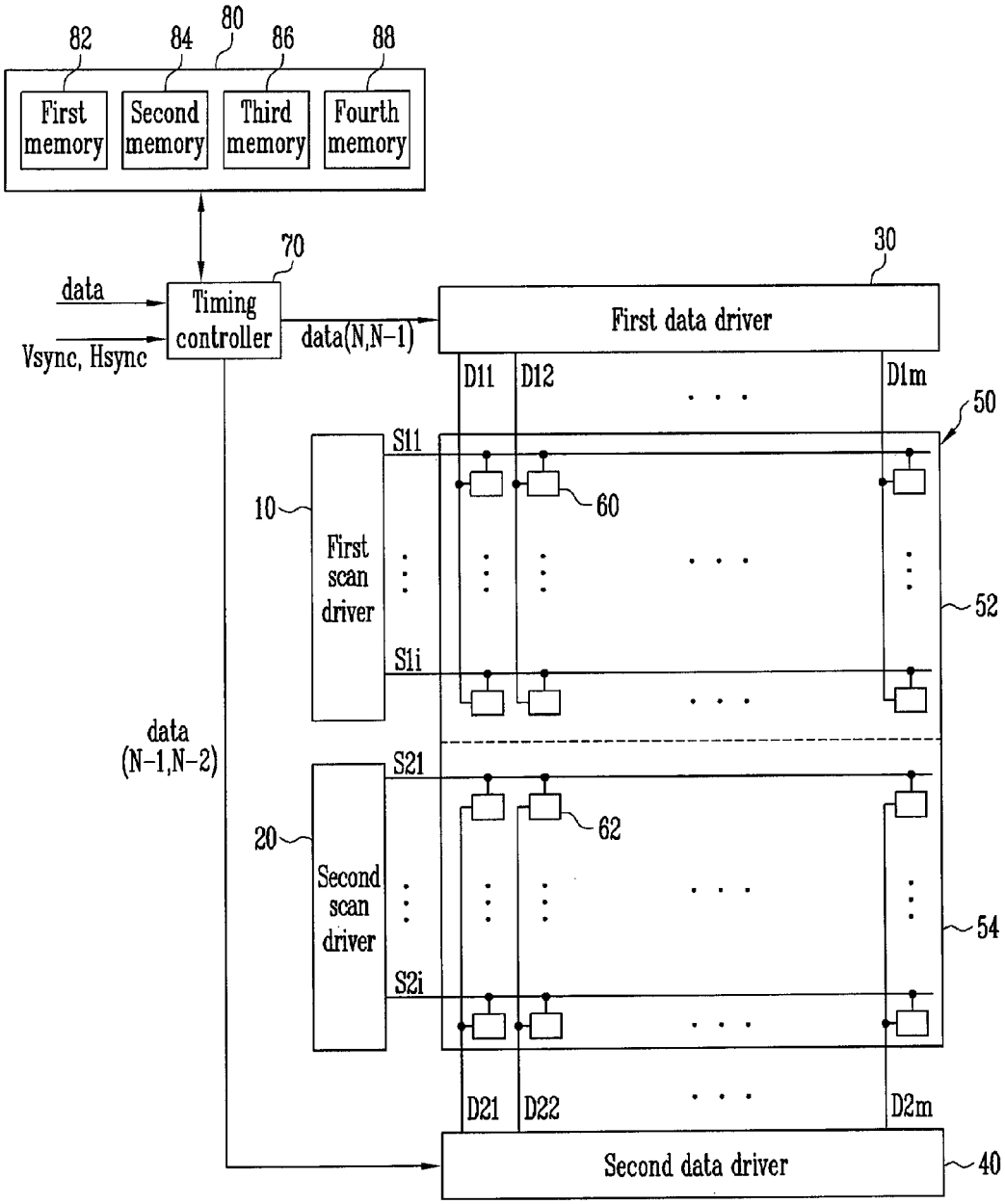
FIG. 1 is a diagram illustrating an organic light emitting display according to an embodiment of the present invention.

Hereinafter, certain example embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention may be omitted for clarity. Also, like reference numerals refer to like elements throughout.

FIG. 1 is a diagram illustrating an organic light emitting display according to an embodiment of the present invention.

Referring to FIG. 1, the organic light emitting display according to this embodiment includes scan drivers 10 and 20, data drivers 30 and 40, a display area (display region or pixel unit) 50 configured to include pixels 60 and 62, a timing controller 70 and a storage unit 80.

The display area 50 is divided into a first display area 52 and a second display area 54. Here, the first display area 52 is positioned at an upper side of the display area 50, and the second display area 54 is positioned at a lower side of the display area 50. The first display area 52 includes a plurality of pixels (e.g., a first plurality of pixels) 60, and the second display area 54 includes a plurality of pixels (e.g., a second plurality of pixels) 62. The first and second display areas 52 and 54 are concurrently (or simultaneously) driven by corresponding different drivers from each other.

The first display area 52 includes first pixels 60 respectively positioned in areas defined by first scan lines S11 to S1*i* and first data lines D11 to D1*m*. The first pixels 60 are applied with (e.g., charge) the voltage of a data signal supplied from the first data lines D11 to D1*m* while being selected for each horizontal line when a first scan signal is supplied to the first scan lines S11 to S1*i*. The first pixels 60 applied with (e.g., charging) the voltage corresponding to the data signal implement gray scales while being turned on and turned off corresponding to the data signal. The first pixels 60 may be implemented with various suitable types (or kinds) of circuits in the art.

The second display area 54 includes second pixels 62 respectively positioned in areas defined by second scan lines S21 to S2*i* and second data lines D21 and D2*m*. The second pixels 62 are applied with (e.g., charge) the voltage of a data signal supplied from the second data lines D21 to D2*m* while being selected for each horizontal line when a second scan signal is supplied to the second scan lines S21 to S2*i*. The second pixels 62 applied with (e.g., charging) the voltage corresponding to the data signal implements gray scales while being turned on and turned off corresponding to the data signal. The second pixels 62 may be implemented with various suitable types of circuits in the art.

A first scan driver 10 supplies the first scan signal to the first scan lines S11 to S1*i*. Here, the first scan driver 10 non-sequentially supplies the first scan signal to the first scan lines S11 to S1*i*, corresponding to a driving method.

A second scan driver 20 supplies the second scan signal to the second scan lines S21 to S2*i*. Here, the second scan driver 20 non-sequentially supplies the second scan signal to the second scan lines S21 to S2*i*, corresponding to a driving method.

A first data driver 30 receives at least some data of an N-th (N is a natural number) frame (ot N frame) and an (N−1)-th frame (or an (N−1) frame), supplied from the timing controller 70. The first data driver 30 receiving the data generates a data signal to correspond to the non-sequentially supplied first scan signal, and supplies the generated data signal to the first data lines D11 to D1*m*.

A second data driver 40 receives at least some data of the (N−1)-th frame and an (N−2)-th frame (or (N−2) frame), supplied from the timing controller 70. The second data driver 40 receiving the data generates a data signal to correspond to the non-sequentially supplied second scan signal, and supplies the generated data signal to the second data lines D21 to D2*m*.

The storage unit 80 stores data of at least three frames under the control of the timing controller 70, and supplies the stored data to the data drivers 30 and 40 via the timing controller 70. To this end, the storage unit 80 includes a first memory 82, a second memory 84, a third memory 86 and a fourth memory 88.

A specific memory (any one of 82 to 88) among the first to fourth memories 82 to 88 (i.e., 82, 84, 86, and 88) supplies, to the timing controller 70, data of three frames, which are previously stored during a specific frame period. In addition, memories except the specific memory (the other memories except any one of 82 to 88) store the data of the specific frame period. An operating process related to the memories 82 to 88 will be described in more detail later.

The timing controller 70 receives synchronization signals including a horizontal synchronization signal Hsync and a vertical synchronization signal Vsync and data, supplied from an outside thereof. The timing controller 70 receiving the synchronization signals controls the data drivers 30 and 40 and the scan drivers 10 and 20, corresponding to the synchronization signals. Here, the timing controller 70 generates a data enable signal to be supplied to the data drivers 30 and 40, corresponding to the synchronization signals. The data enable signal is supplied to each of the data drivers 30 and 40. The data enable signal is used (or utilized) as a reference clock signal for supplying a data signal. For example, the data drivers 30 and 40 supply a data signal to the data lines D11 to D1*m* and D21 to D2*m* whenever the data enable signal is supplied.

The timing controller 70 receiving the data stores the data in the storage unit 80. The timing controller 70 extracts data of three frames, and supplies the extracted data to the data drivers 30 and 40. For example, the timing controller 70 supplies at least some data of the N-th and (N−1)-th frames to the first data driver 30, and supplies at least some data of the (N−1)-th and (N−2)-th frames to the second data driver 40.

Figure 2:
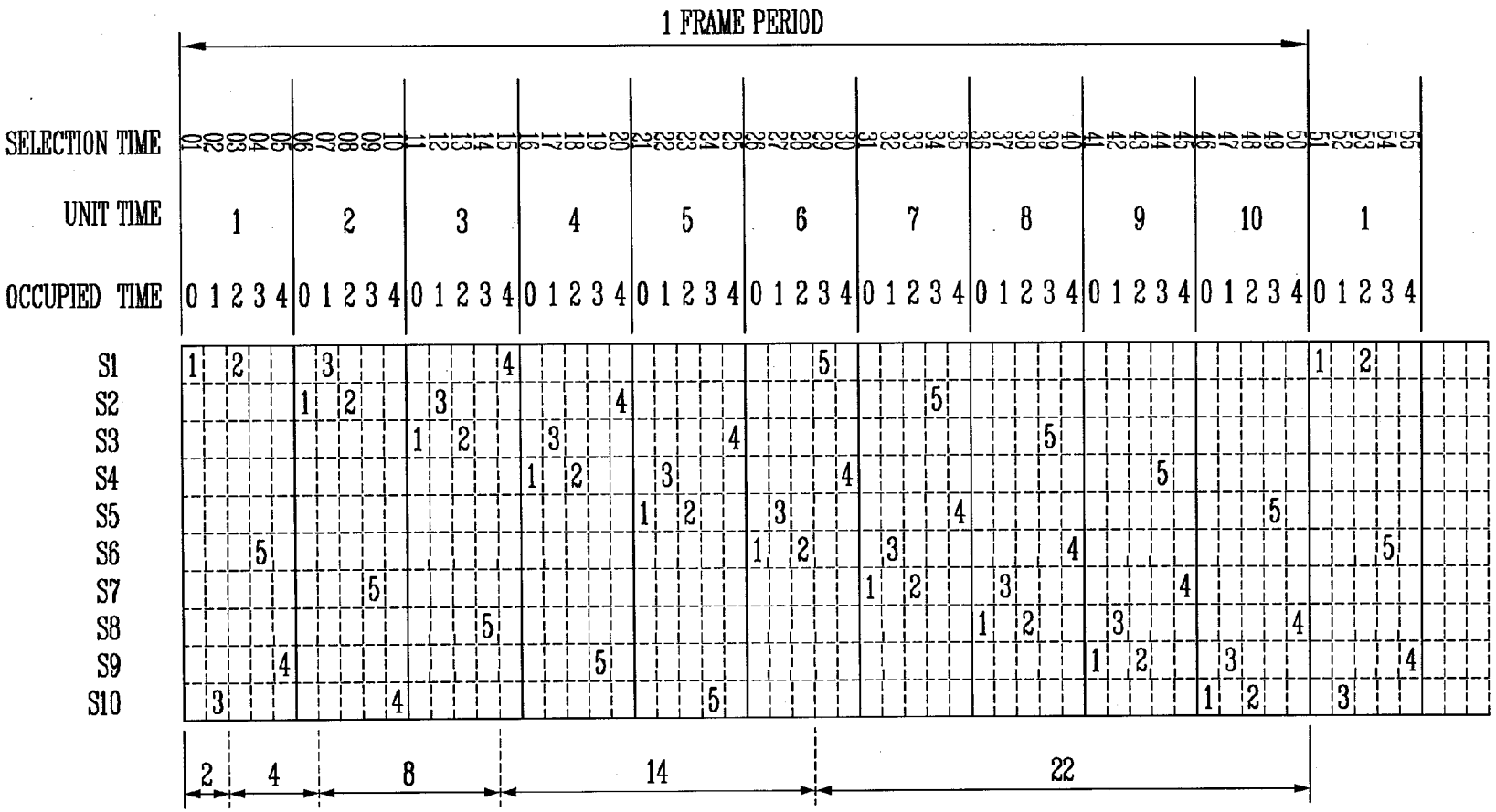
FIG. 2 is a diagram illustrating a driving method according to an embodiment of the present invention.

FIG. 2 is a diagram illustrating a driving method according to an embodiment of the present invention. In FIG. 2, it is assumed that, for convenience of illustration, 10 scan lines S1 to S10 are included in each of the first to second display areas 52 and 54.

In FIG. 2, "selection time" refers to a selection time as a minimum unit. During the selection time, a scan signal is supplied to any one scan line. "Unit time" refers to a time divided using (or utilizing) one frame as a control unit. "Occupied time" is equally included in each unit time, and refers to a time when a data signal is supplied to a data line.

During the unit time, a scan signal is non-sequentially supplied to scan lines. In addition, a data signal corresponding to a weight (e.g., a predetermined weight) is supplied to be synchronized with the scan signal during the unit time. Here, the data signal supplied during the unit time may be set to have different weights (e.g., gray scales).

For example, the data signal may be set to have weights of "2", "4", "8", "14" and "22", corresponding to a gray scale to be displayed. In this case, one frame includes five sub-frames. When a data signal corresponding to the weight of "2" is supplied, a corresponding pixel emits light during two selection times. When a data signal corresponding to the weight of "14" is supplied, a corresponding pixel emits light during fourteen selection times. That is, in embodiments of the present invention, an image (e.g., a predetermined image) is displayed while non-sequentially supplying a scan signal, and supplying data signals having different emission times (e.g., different weights) during the unit time, corresponding to the non-sequentially supplied scan signal.

Figure 3:
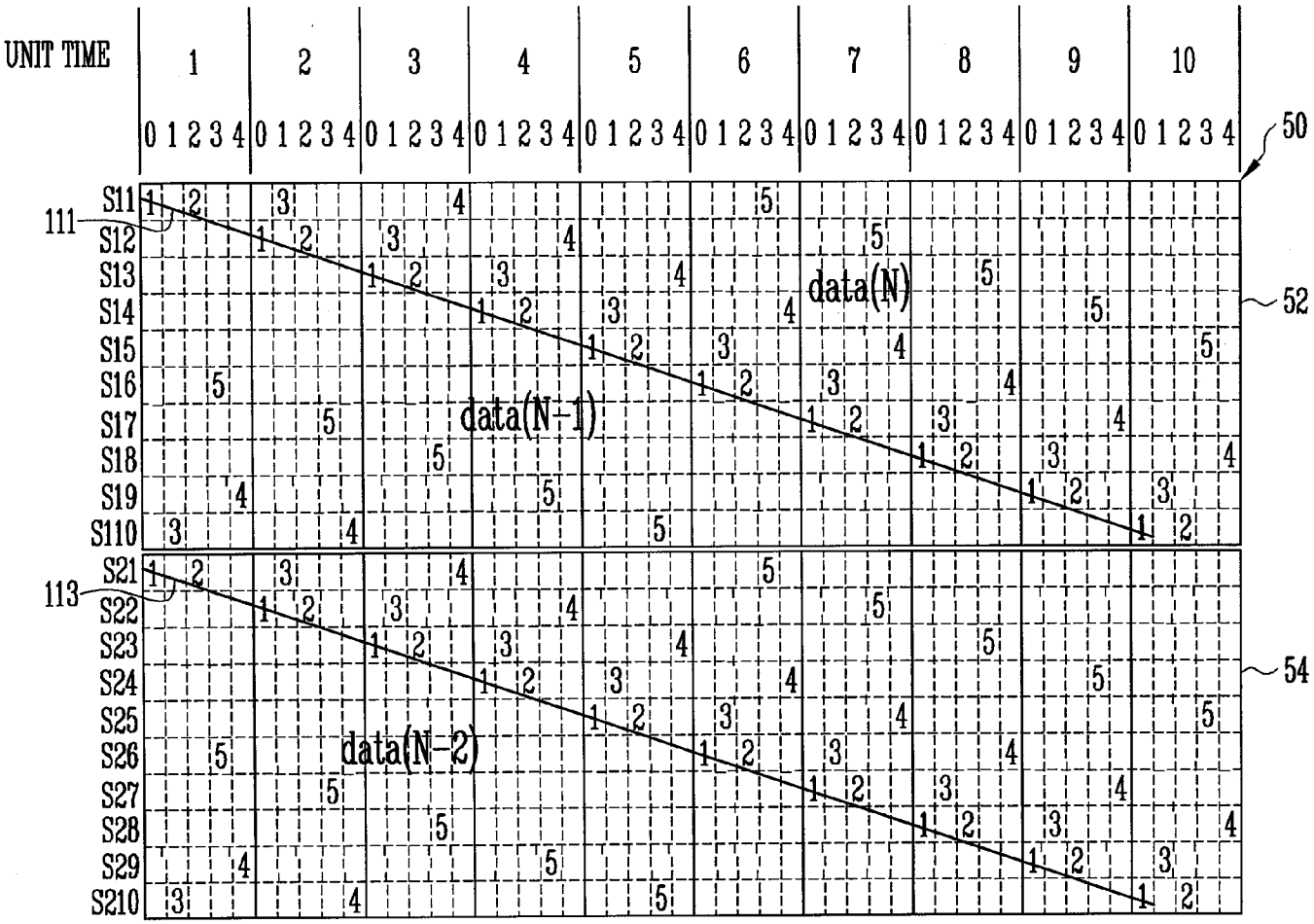
FIG. 3 is a diagram illustrating gray scales displayed in pixels corresponding to the driving method shown in FIG. 2, according to an embodiment of the present invention.

FIG. 3 is a diagram illustrating gray scales displayed in pixels corresponding to the driving method shown in FIG. 2, according to an embodiment of the present invention.

Referring to FIG. 3, during a first unit time, the first scan driver 10 non-sequentially supplies a first scan signal. Here, the primary first scan signal supplied during the first unit time is supplied to a primary first scan line S11. During the first unit time, the first data driver 30 supplies a data signal with a weight (e.g., a predetermined weight) to the first data lines D11 to D1*m* to be synchronized with the first scan signal.

During a second unit time, the first scan driver 10 non-sequentially supplies the first scan signal. Here, the primary first scan signal supplied during the second unit time is supplied to a secondary first scan line S12. During the second unit time, the first data driver 30 supplies a data signal with a weight (e.g., a predetermined weight) to the first data lines D11 to D1*m* to be synchronized with the first scan signal.

For example, in embodiments of the present invention, a data signal is supplied to the first pixels 60 while repeating the process described above during first to tenth unit times. If the pixels receiving the primary first scan signal supplied during each unit time are coupled (e.g., connected), this may be represented as a diagonal line 111. Here, the upper side based on the diagonal line 111 receives a data signal corresponding to the data of the N-th frame, and the lower side based on the diagonal line 111 receives a data signal corresponding to the data of the (N−1)-th frame. That is, the first display area 52 receives a data signal corresponding to the data of the N-th and (N−1)-th frames, corresponding to the driving method, and displays an image corresponding to the data signal.

During the first unit time, the second scan driver 20 non-sequentially supplies a second scan signal. Here, the primary second scan signal supplied during the first unit time is supplied to a primary second scan line S21. During the first unit time, the second data driver 40 supplies a data signal with a weight (e.g., a predetermined weight) to the second data lines D21 to D2*m* to be synchronized with the second scan signal.

During the second unit time, the second scan driver 20 non-sequentially supplies the second scan signal. Here, the primary second scan signal supplied during the second unit time is supplied to a secondary second scan line S22. During the second unit time, the second data driver 40 supplies a data signal with a weight (e.g., a predetermined weight) to the second data lines D21 to D2*m* to be synchronized with the second scan signal.

For example, in embodiments of the present invention, a data signal is supplied to the second pixels 62 while repeating the process described above during the first to tenth unit times. When the pixels receiving the primary second scan signal supplied during each unit time are coupled (e.g., connected), this may be represented as a diagonal line 113. Here, the upper side based on the diagonal line 113 receives a data signal corresponding to the data of the (N−1)-th frame, and the lower side based on the diagonal line 113 receives a data signal corresponding to the data of the (N−2)-th frame. That is, the second display area 54 receives a data signal corresponding to the data of the (N−1)-th and (N−2)-th frames, corresponding to the driving method, and displays an image corresponding to the data signal. When the display area 50 is driven in the state in which the display area 50 is divided into the upper and lower sides as described above, it is possible to sufficiently secure a charging time of the pixels 60 and 62, thereby increasing (e.g., improving) display quality.

Figure 4:
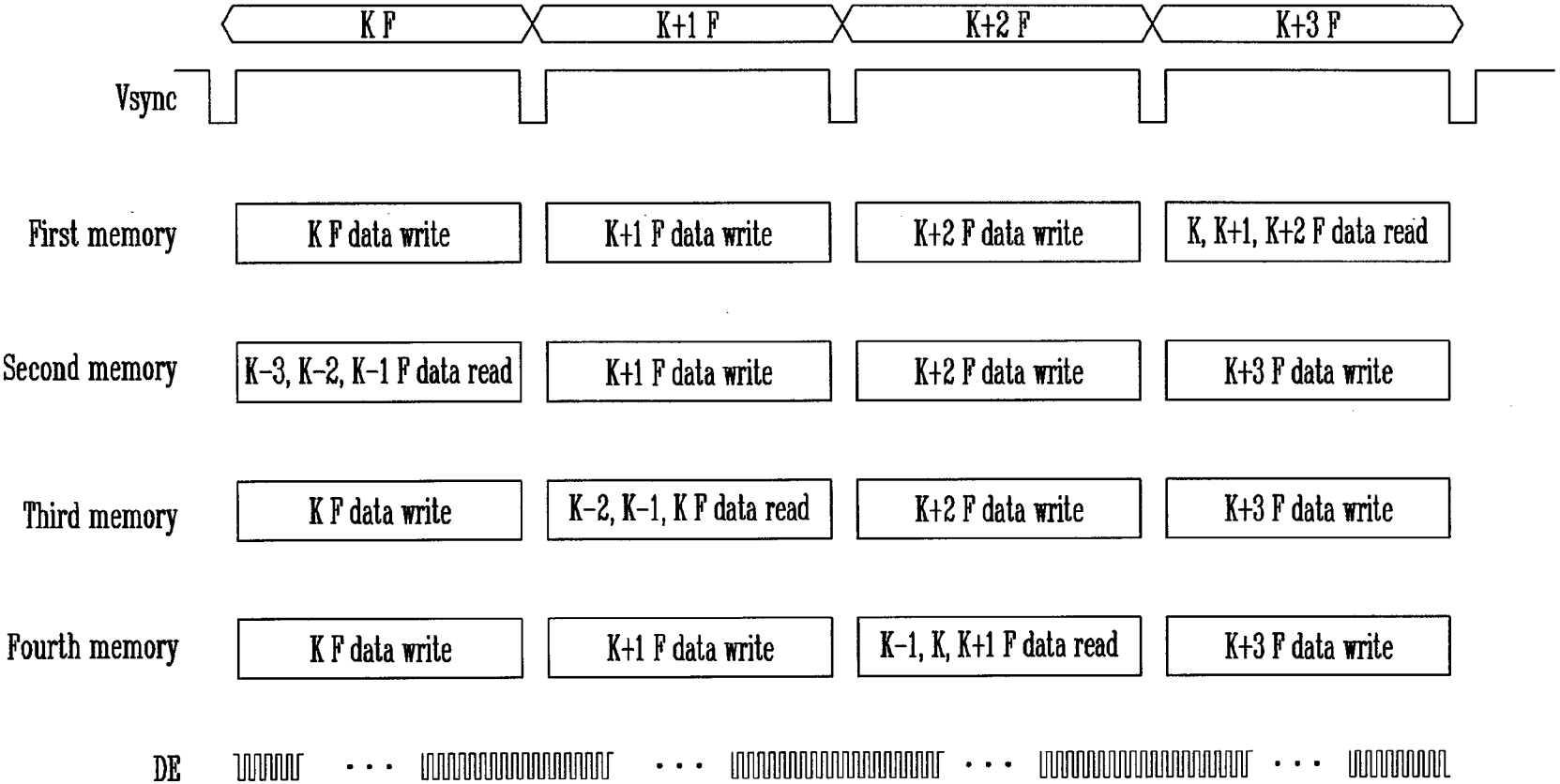
FIG. 4 is a diagram illustrating data stored in memories corresponding to a frame period, according to an embodiment of the present invention.

FIG. 4 is a diagram illustrating data stored in memories corresponding to a frame period, according to an embodiment of the present invention.

Referring to FIG. 4, during a k-th (k is a natural number) frame (or a k frame), the timing controller 70 extracts data of (k−3)-th, (k−2)-th and (k−1)-th frames (or (k−3), (k−2), and (k−1) frames), stored in the second memory 84, and supplies the extracted data to the first and second data drivers 30 and 40. During the k-th frame period, the first, third and fourth memories 82, 86 and 88 store data of a k-th frame.

During a (k+1)-th frame period, the timing controller 70 extracts data of (k−2)-th, (k−1)-th and k-th frames, stored in the third memory 86, and supplies the extracted data to the first and second data drivers 30 and 40. During the (k+1)-th frame period, the first, second and fourth memories 82, 84 and 88 store data of a (k+1)-th frame.

During a (k+2)-th frame period, the timing controller 70 extracts data of (k−1)-th, k-th and (k+1)-th frames, stored in the fourth memory 88, and supplies the extracted data to the first and second data drivers 30 and 40. During the (k+2)-th frame period, the first to third memories 82 to 86 store data of a (k+2)-th frame.

During a (k+3)-th frame period, the timing controller 70 extracts data of k-th, (k+1)-th and (k+2)-th frames, stored in the first memory 82, and supplies the extracted data to the first and second data drivers 30 and 40. During the (k+3)-th frame period, the second to fourth memories 84 to 88 store data of a (k+3)-th frame.

As described above, during every frame period, the timing controller 70 extracts data from a memory (any one of 82 to 88) storing data of three frames and supplies the extracted data to the first and second data drivers 30 and 40. During the frame period, the memories (three of 82 to 88), from which data are not extracted, store data of a current frame. In this case, the timing controller 70 is coupled to the first to fourth memories every frame period to thereby extract data.

Figure 5:
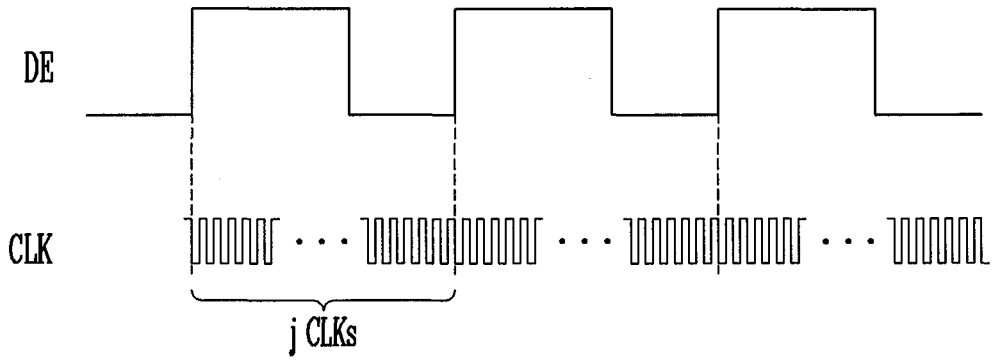
FIG. 5 is a diagram illustrating a data enable signal generated in a timing controller according to an embodiment of the present invention.

FIG. 5 is a diagram illustrating a data enable signal generated in the timing controller according to an embodiment of the present invention.

Referring to FIG. 5, the timing controller 70 generates a data enable signal DE, using (or utilizing) an internal clock signal CLK. As an example, the timing controller 70 may generate the data enable signal DE so that j (j is a natural number) clock signals CLK are included in one period. For example, when the j is set to 100, the timing controller 70 generates the data enable signal DE so that 100 clock signals CLK are included in one period (e.g., set to one period).

The data enable signal DE is used (or utilized) as a reference clock signal for supplying a data signal. Therefore, the data enable signal DE is set so that the blank period in one frame period is decreased (e.g., minimized). For example, as the blank period is widened by the data enable signal DE, the boundary portion between the first and second display areas 52 and 54 is easily recognized, and accordingly, the display quality of the organic light emitting display is deteriorated. In addition, when the blank period is widened by the data enable signal DE, an error may easily occur due to a difference in frequency between the first and second display areas 52 and 54.

Figure 6:
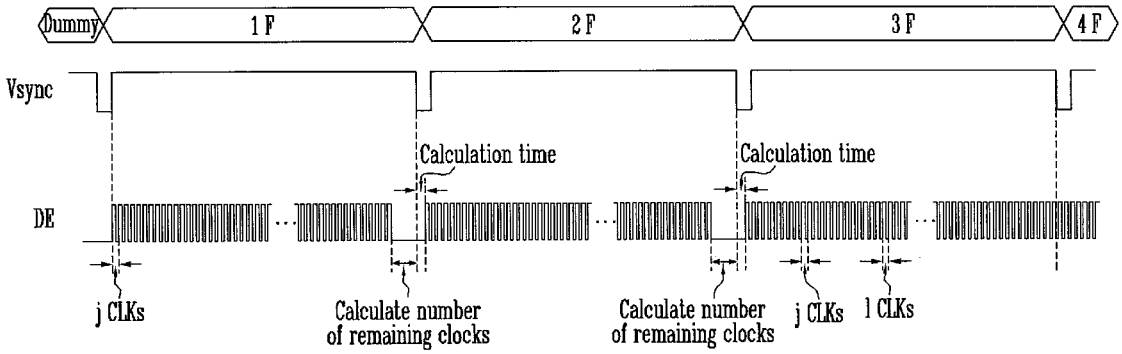
FIG. 6 is a diagram illustrating a method of generating the data enable signal according to an embodiment of the present invention.

FIG. 6 is a diagram illustrating a method of generating the data enable signal according to an embodiment of the present invention.

Referring to FIG. 6, first, the timing controller 70 controls the width of the data enable signal DE so that the blank period is decreased (e.g., minimized) during a plurality of frame periods after power is input. Here, the number of data enable signals DE(T) is calculated by dividing longitudinal resolution by 2 (corresponding to the division of the display area), and then multiplying the divided result by the number of sub-frames.

For example, after the power is input, the timing controller 70 generates the data enable signal DE (initial data enable signal) so that j clock signals CLK are included in one period during a first frame period 1F. Here, the j is the number of clock signals CLK (e.g., which is previously set).

The timing controller 70 generates the data enable signal DE so that the j clock signals CLK are included in the one period, and then calculates the number of clock signals CLK (hereinafter, referred to "remaining clocks") supplied during a period in which the data enable signal DE is not generated in the frame period, i.e., during a blank period. That is, the number of remaining clocks CLK(R) is obtained by counting the number of clock signals CLK supplied during the blank period.

Subsequently, during a calculation time between first and second frame periods 1F and 2F, the timing controller 70 obtains the number of clock signals CLK to be included in one period of the data enable signal DE, using (or utilizing) Equation 1. Here, the calculation time is a short time of a few nanoseconds (ns), which has little influence on the number of data enable signals DE.

$$CLK(N) = CLK(O) + \text{int}\left(\frac{CLK(R)}{DE(T)}\right) \quad \text{Equation 1}$$

In Equation 1, CLK(N) denotes the number of new clock signals CLK to be included in one period of the data enable signal DE, CLK(O) denotes the number (i.e., j) of clock signals CLK included in the one period of the data enable signal DE during a previous frame period, CLK(R) denotes the number of remaining clocks supplied during the blank period, and DE(T) denotes the number of data enable signals DE included in one frame. In addition, int denotes taking only an integer part from the value obtained by dividing the number of remaining clocks CLK(R) into the number of data enable signals DE(T) included in one frame.

For example, when the number of data enable signals DE(T) is 8640 and the number of remaining clocks CLK(R) is 8600, int(CLK(R)/DET(T)) is set to "0". In this case, CLK(N) is set to the same value as CLK(O). That is, the data enable signal DE set to the same period as the first frame period 1F is supplied during the second frame period 2F.

Subsequently, the timing controller 70 counts the number of remaining clocks CLK(R) during the blank period of the second frame period 2F. The timing controller 70 calculates the number of data enable signals DE (e.g., first data enable signals) each having a period of j clock signals CLK and the number of data enable signals DE (e.g., second data enable signals) each having a period of l (l is a natural number greater than j, for example j+1) clock signals CLK so that the data enable signal DE can be supplied with decreased (e.g., no) blank period during a calculation time between second and third frame periods 2F and 3F. The timing controller 70 supplies concurrently (e.g., simultaneously) the first and second data enable signals having different periods from each other during the third frame period 3F. Then, the data enable signal DE can be supplied with decreased (e.g., no) blank period during the third frame period 3F. That is, in embodiments of the present invention, data enable signals DE having different periods from each other are supplied concurrently (e.g., simultaneously), so that it is possible to decrease (e.g., minimize) the blank period. Additionally, in embodiments of the present invention, at least one or more frames may include a period in which the first and second enable signals are supplied concurrently (e.g., simultaneously).

The process described above is performed during the first to third frame periods after the power is input. During the first and third frame periods, no data signal is supplied to the data drivers 30 and 40, and accordingly, it is possible to reduce (e.g., prevent) the displaying of an undesired image in the display area 50. Subsequently, the data signal is supplied to the data drivers 30 and 40, corresponding to the first and second data enable signals having different periods from each other during a driving period in which an image is displayed. Accordingly, a desired image can be stably displayed.

Figure 7:
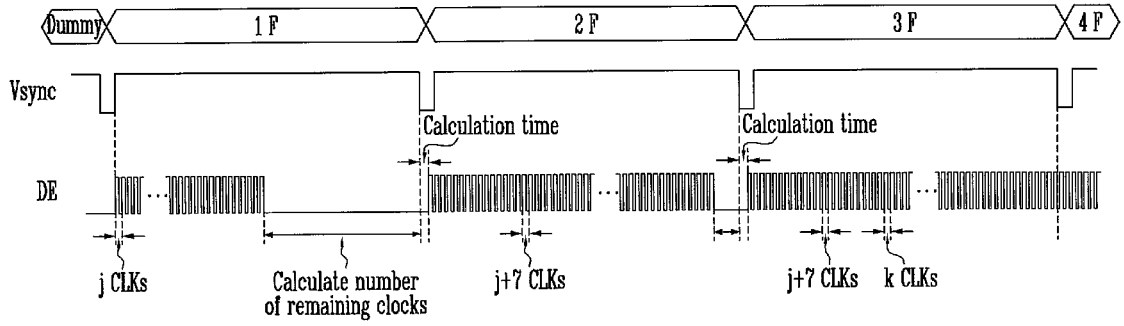
FIG. 7 is a diagram illustrating a method of generating the data enable signal according to another embodiment of the present invention.

FIG. 7 is a diagram illustrating a method of generating the data enable signal according to another embodiment of the present invention.

Referring to FIG. 7, the timing controller 70 generates the data enable signal DE so that j clock signals CLK are included in one period during the first frame period 1F.

The timing controller 70 generates the data enable signal DE so that the j clock signals CLK are included in the one period, and calculates the number of remaining clocks CLK(R) supplied during a blank period. Subsequently, during the calculation time between the first and second frame periods 1F and 2F, the timing controller 70 obtains the number of clock signals CLK to be included in one period of the data enable signal DE, using (or utilizing) Equation 1.

For example, when the number of data enable signals DE(T) is 8640 and the number of remaining clocks CLK(R) is 62000, int(CLK(R)/DET(T)) becomes "7". In this case, CLK(N) is set to a value greater than CLK(O) by "7". That is, during the second frame period 2F, the data enable signal DE is generated so that j+7 clock signals CLK are included in one period.

In Equation 1, an integer value is extracted corresponding to the number of data enable signals DE(T) and the number of remaining clocks CLK(R). Here, the integer value sets to "1", "2", . . . or the like, corresponding to the number of remaining clocks CLK(R). Thus, int(CLK(R)/DE(T)) becomes "0" in the second frame period 2F after the first frame period 1F.

Subsequently, the timing controller 70 counts the number of remaining clocks CLK(R) during the blank period of the second frame period 2F. The timing controller 70 calculates the number of first data enable signals, each having a period of j+7 clock signals CLK, and the number of second data enable signals, each having a period of k (k is a natural number greater than j+7) clock signals CLK, so that the data enable signal DE can be supplied with decreased (e.g., no) blank period in one frame period during the calculation time between the second and third frame periods 2F and 3F.

The timing controller 70 supplies concurrently (or simultaneously) the first and second data enable signals during the third frame period 3F. Then, the data enable signal DE can be supplied with decreased (e.g., no) blank period during the third frame period 3F. That is, in embodiments of the present invention, the first and second data enable signals are supplied concurrently (e.g., simultaneously) so that the blank period is decreased (e.g., minimized), and accordingly, a desired image can be stably displayed.

There may occur a case where a frame period is changed while an image (e.g., a predetermined image) is being expressed. For example, when the frame period is widened during driving, the period of the data enable signal DE is controlled by the driving methods shown in FIGS. 6 and 7, and accordingly, a desired image can be stably displayed. When the frame period is shortened during driving, the period of the data enable signal DE is controlled by a driving method shown in FIG. 8.

Figure 8:
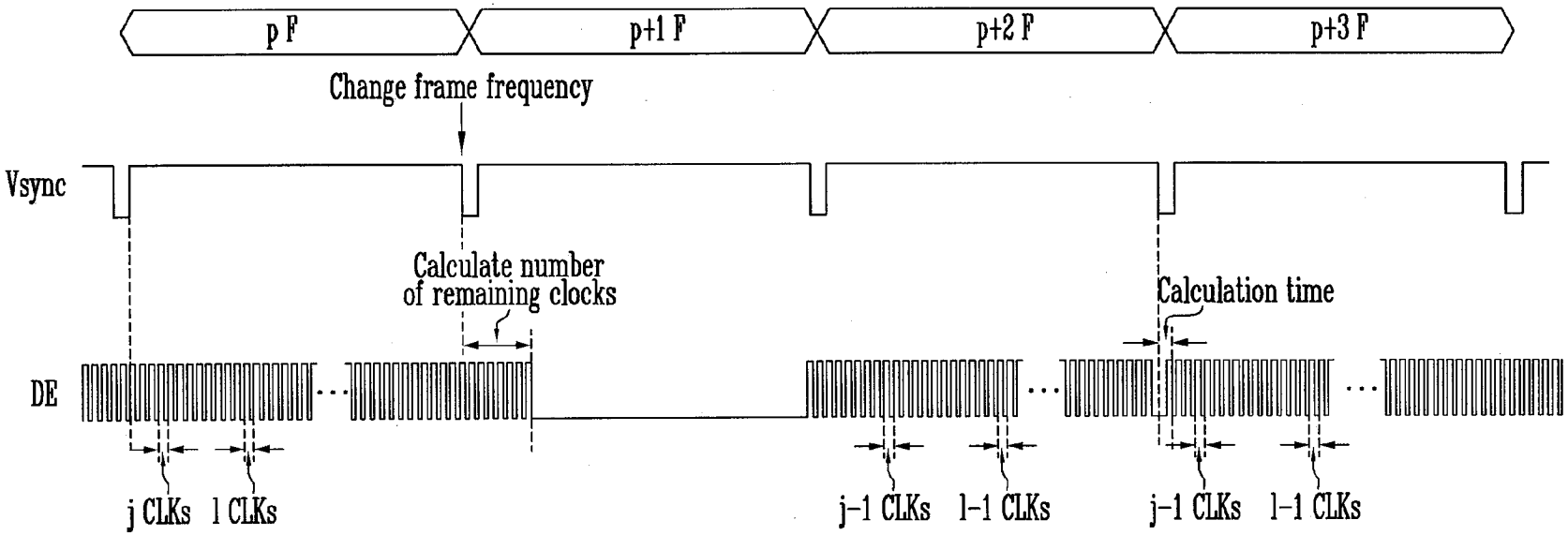
FIG. 8 is a diagram illustrating a method of generating the data enable signal according to still another embodiment of the present invention.

FIG. 8 is a diagram illustrating a method of generating the data enable signal according to still another embodiment of the present invention.

Referring to FIG. 8, the timing controller 70 supplies the first data enable signal having a first period corresponding to j clock signals CLK and the second data enable signal having a second period corresponding to one clock signal CLK so that the blank period is decreased (e.g., minimized) during a driving period.

Here, when the frame period is shortened as the driving frequency is changed, the timing controller 70 calculates the number of remaining clocks CLK(R') additionally supplied during P (P is a natural number)+one frame period (P+1F). After the number of remaining clocks CLK(R') is calculated, the timing controller 70 calculates the number of clock signals CLK to be included in one period of the data enable signal DE, using Equation 2.

$$CLK(N) = CLK(O) - \text{int}\left(\frac{CLK(R')}{DE(T)}\right) - 1 \quad \text{Equation 2}$$

In Equation 2, CLK(N) denotes the number of new clock signals CLK to be included in one period of the data enable signal DE, and CLK(O) denotes the number (e.g., j, l) of clock signals CLK included in the one period of the data enable signal DE during a previous frame period.

For example, when the number of data enable signals DE(T) is 8640 and the number of additionally supplied remaining clocks CLK(R') is 8000, int(CLK(R')/DET(T)) becomes "0". However, "−1" is included in Equation 2, and hence CLK(N) obtained by subtracting "1" from CLK(O) is generated even though the result of int(CLK(R')/DET(T)) is "0".

Subsequently, during a (P+2)-th frame period P+2F, the timing controller 70 supplies concurrently (e.g., simultaneously) the first data enable signal having a period corresponding to (j−1) clock signals CLK and the second data enable signal having a period corresponding to (l−1) clock signals CLK. The timing controller 70 controls the number of first and second data enable signals so that the data enable signal DE can be supplied with decreased (e.g., no) blank period during a calculation period between the (P+2)-th frame period P+2F and a (P+3)-th frame period P+3F. For example, the timing controller 70 may increase the number of second data enable signals having a wide period and decrease the number of first data enable signal having a short period.

During the (P+3)-th frame period P+3F, the timing controller 70 supplies the first and second data enable signals of which numbers are controlled. Then, the data enable signal DE can be supplied with decreased (e.g., no) blank period during the (P+3)-th frame period P+3F.

Additionally, although it has been described in this embodiment that the first and second data enable signals are supplied during the (P+3)-th frame period P+3F, the present invention is not limited thereto. For example, in embodiments of the present invention, a third data enable signal having a period wider than that of the second data enable signal (e.g., having a period corresponding to clock signals with a number greater than that of the (l−1) clock signals CLK) may be additionally supplied.

For example, in embodiments of the present invention, the period of the data enable signal DE is controlled while repeating the process described above so that the blank period is decreased (e.g., minimized) when the power is input or when the driving frequency is changed.

By way of summation and review, among flat panel displays, an organic light emitting display displays images using (or utilizing) organic light emitting diodes that emit light through recombination of electrons and holes. The organic light emitting display has a fast response speed and is driven with low power consumption.

The organic light emitting display includes a data driver configured to supply data lines, a scan driver configured to supply scan lines, and pixels respectively positioned in areas defined by the scan lines and the data lines (e.g., at crossings of the scan lines and the data lines). Each pixel emits light with a set luminance (e.g., a predetermined luminance) while supplying current from a driving transistor to an organic light emitting diode, corresponding to a data signal.

With the development of technologies, studies on an organic light emitting display having a panel of 40 inches or more have been conducted. However, when the organic light emitting display has a panel of 40 inches or more, a desired voltage is not applied in each pixel, and therefore, the image quality of the organic light emitting display is deteriorated.

In the organic light emitting display and the driving method thereof according to embodiments of the present invention, the display area is driven in the state in which the display area is divided into upper and lower sides, so that a voltage can be applied in each pixel for a sufficient time, thereby increasing (e.g., improving) the display quality of the organic light emitting display. Further, the width of the data enable signal is controlled so that the blank period is decreased (e.g., minimized), and accordingly, it is possible to reduce (e.g., prevent) the boundary portion between the upper and lower sides of the display area from being observed.

Example embodiments of the present invention have been disclosed herein, and although specific terms are employed, they are used and are to be interpreted in a generic and descriptive sense only and not for purposes of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display comprising:

a data driver configured to supply a data signal to data lines, corresponding to a data enable signal during a driving period in which an image is displayed; and a timing controller configured to supply data and the data enable signal to the data driver, wherein the timing controller is configured to:

generate and supply an initial data enable signal so that j clock signals are included in one period during an i-th frame period after power is input, wherein j is a natural number, supply the initial data enable signal during an (i+1)-th frame period by controlling the period of the initial data enable signal to reduce a first blank period in which the initial data enable signal is not supplied in the i-th frame period, and supply concurrently a first data enable signal having a first period and a second data enable signal having a second period differing from the first period to decrease a second blank period in the (i+1)-th frame period during a (i+2)-th frame period.

2. The organic light emitting display of claim 1, wherein the timing controller is configured to:

calculate a number of clock signals supplied during the first blank period; and control a number of clock signals to be included in the period of the initial data enable signal during a (i+1)-th frame period, using the following:

$$CLK(N) = CLK(O) + \text{int}\left(\frac{CLK(R)}{DE(T)}\right),$$

and wherein CLK(N) denotes the number of clock signals to be included in one period of the initial data enable signal during the (i+1)-th frame period, CLK(O) denotes the number of clock signals included in the one period of the initial data enable signal during the i-th frame period, CLK(R) denotes the number of clock signals supplied during the first blank period, DE(T)

denotes the total number of data enable signals to be supplied in one frame period, and int denotes taking only an integer.

3. The organic light emitting display of claim 2, wherein the timing controller is configured to:

supply the initial data enable signal by controlling the period of the initial data enable signal so that p clock signals are included in one period, corresponding to the equation, during the (i+1)-th frame period, wherein p is a natural number equal to or greater than j;

calculate a number of clock signals supplied during the second blank period of the (i+1)-th frame period; and generate the first data enable signal including p clock signals in the one period and the second data enable signal including l clock signals in the one period, to reduce the second blank period, and supply the generated first and second data enable signals to the (i+2)-th frame period, wherein l is a natural number greater than p.

4. The organic light emitting display of claim 1, wherein, when the i-th frame period is shortened in the driving period, the timing controller is configured to calculate a number of clock signals additionally supplied after the i-th frame period, and to control widths of the first and second periods by the following:

$$CLK(N) = CLK(O) - \text{int}\left(\frac{CLK(R')}{DE(T)}\right) - 1,$$

and wherein CLK(O) denotes a number of clock signals included in the one period of each of the first and second data enable signals, CLK(N) denotes the number of clock signals to be included in the one period of each of the first and second data enable signals, CLK (R') denotes a number of the additionally supplied clock signals, DE(T) denotes a total number of data enable signals to be supplied in one frame period, and int denotes taking only an integer.

5. The organic light emitting display of claim 4, wherein the timing controller is configured to:

control widths of the first and second periods corresponding to the equation, and calculate the number of clock signals supplied during the first and second blank periods; and control the number of the first and second data enable signals to reduce the first and second blank periods during the (i+2)-th frame period.

6. The organic light emitting display of claim 1, wherein the data lines include first data lines at a first display area at an upper side of a panel, and second data lines at a second display area at a lower side of the panel, and wherein the data driver includes a first data driver configured to drive the first data lines, and a second data driver configured to drive the second data lines.

7. The organic light emitting display of claim 6, further comprising:

first scan lines at the first display area;

second scan lines at the second display area;

a first scan driver configured to non-sequentially supply a scan signal to the first scan lines; and a second scan driver configured to non-sequentially supply a scan signal to the second scan lines.

8. The organic light emitting display of claim 6, wherein the first display area is configured to display an image corresponding to data of an N-th frame period and an (N−1)-th frame period, wherein N is a natural number, and wherein the second display area is configured to display an image corresponding to data of the (N−1)-th frame period and an (N−2)-th frame period.

9. The organic light emitting display of claim 6, further comprising a storage unit comprising four memories to supply data of three frame periods to the timing controller.

10. A method of driving an organic light emitting display, the method comprising:

supplying an initial data enable signal during an i-th frame period, wherein i is a natural number;

calculating a number of clock signals supplied during a first blank period in which the initial data enable signal is not supplied in the i-th frame period;

supplying the initial data enable signal during an (i+1)-th frame period by controlling the period of the initial data enable signal to reduce the first blank period;

calculating a number of clock signals supplied during a second blank period in the (i+1)-th frame period; and supplying concurrently a first data enable signal having a first period and a second data enable signal having a second period differing from the first period to decrease the second blank period during a (i+2)-th frame period.

11. The method of claim 10, wherein, the period of the initial data enable signal is controlled by the following:

$$CLK(N) = CLK(O) + \text{int}\left(\frac{CLK(R)}{DE(T)}\right),$$

and wherein CLK(N) denotes a number of clock signals to be included in one period of the initial data enable signal during the (i+1)-th frame period, CLK(O) denotes a number of clock signals included in the one period of the initial data enable signal during the i-th frame period, CLK(R) denotes a number of clock signals supplied during the first blank period, DE(T) denotes a total number of data enable signals to be supplied in one frame period, and int denotes taking only an integer.

12. The method of claim 10, wherein the first period is a period equal to that of the initial data enable signal, and wherein the second period has a width wider than that of the first period.

13. The method of claim 10, further comprising, when a frame period is shortened during driving, calculating a number of clock signals additionally supplied after the shortened frame period, and controlling widths of the first and second periods, by the following:

$$CLK(N) = CLK(O) - \text{int}\left(\frac{CLK(R')}{DE(T)}\right) - 1,$$

and wherein CLK(O) denotes a number of clock signals included in the one period of each of the first and second data enable signals, CLK(N) denotes a number of clock signals to be included in the one period of each of the first and second data enable signals, CLK(R') denotes a number of the additionally supplied clock signals, DE(T) denotes a total number of data enable signals to be supplied in one frame period, and int denotes taking only an integer.

14. The method of claim 10, wherein the i-th frame period is a first frame period after power is input.

15. An organic light emitting display comprising:

a data driver configured to supply a data signal to data lines, corresponding to a data enable signal during a driving period in which an image is displayed; and a timing controller configured to supply data and the data enable signal to the data driver, wherein a first data enable signal having a first period and a second data enable signal having a second period differing from the first period are included in the data enable signal supplied during one frame period, and wherein the timing controller is further configured to:

generate and supply an initial data enable signal so that j clock signals are included in one period during a first frame period after power is input, wherein j is a natural number;

calculate a number of clock signals supplied during a blank period in which the initial data enable signal is not supplied in the first frame period; and control a number of clock signals to be included in the period of the initial data enable signal during a second frame period, using the following:

$$CLK(N) = CLK(O) + \text{int}\left(\frac{CLK(R)}{DE(T)}\right),$$

and wherein CLK(N) denotes the number of clock signals to be included in one period of the initial data enable signal during the second frame period, CLK(O) denotes the number of clock signals included in the one period of the initial data enable signal during the first frame period, CLK(R) denotes the number of clock signals supplied during the blank period, DE(T) denotes the total number of data enable signals to be supplied in one frame period, and int denotes taking only an integer.

16. The organic light emitting display of claim 15, wherein the timing controller is configured to:

supply the initial data enable signal by controlling the period of the initial data enable signal so that p clock signals are included in one period, corresponding to the equation, during the second frame period, wherein p is a natural number equal to or greater than j;

calculate a number of clock signals supplied during the blank period of the second frame period; and generate the first data enable signal including p clock signals in the one period and the second data enable signal including l clock signals in the one period, to reduce the blank period, and supply the generated first and second data enable signals to a next frame period, wherein l is a natural number greater than p.

* * * * *